US005855200A

United States Patent [19]

Jessee

[11] Patent Number: 5,855,200

[45] Date of Patent: Jan. 5, 1999

[54] ARROW REST

[75] Inventor: Edward M. Jessee, Louisville, Ky.

[73] Assignee: Coffey Marketing Corporation, LaGrange, Ky.

[21] Appl. No.: 323,868

[22] Filed: Oct. 17, 1994

[51] Int. Cl.[6] ..... F41B 5/22

[52] U.S. Cl. ..... 124/44.5

[58] Field of Search ..... 124/24.1, 25.6, 124/44.5, 86, 88

[56] References Cited

U.S. PATENT DOCUMENTS

| | | | |
|---|---|---|---|
| 4,074,674 | 2/1978 | Simo | 124/44.5 |
| 4,662,346 | 5/1987 | Laffin | 124/44.5 |
| 4,703,745 | 11/1987 | Hammond | 124/44.5 |
| 4,899,716 | 2/1990 | Martin et al. | 124/44.5 |
| 5,181,502 | 1/1993 | Ray | 124/44.5 |
| 5,213,090 | 5/1993 | Tone | 124/44.5 |
| 5,251,606 | 10/1993 | Colvin | 124/44.5 |
| 5,353,778 | 10/1994 | Blankenship | 124/44.5 |
| 5,372,119 | 12/1994 | Kidney | 124/44.5 |
| 5,429,107 | 7/1995 | Troncoso | 124/44.5 |
| 5,460,152 | 10/1995 | Specht | 124/44.5 |
| 5,462,041 | 10/1995 | Solecki | 124/44.5 |

*Primary Examiner*—John A. Ricci
*Attorney, Agent, or Firm*—David W. Carrithers

[57] ABSTRACT

Arrow rest arrangement for an archery bow including a rod rotatably received in base member attached to the bow where a pin extends outwardly from the rod and holds an arrow rest which is formed from low friction polymer and adapted to support an arrow prior to launching and provide initial guidance to the arrow at launch. Several embodiments of invention are shown.

18 Claims, 2 Drawing Sheets

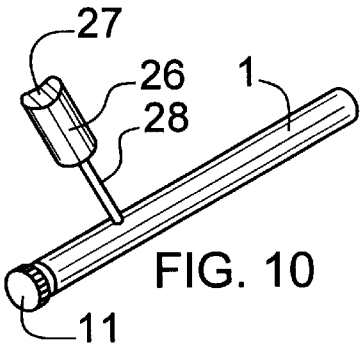
FIG. 10
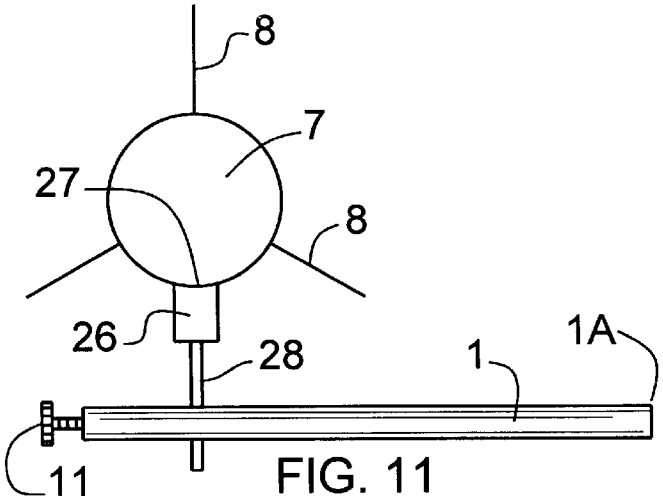
FIG. 11
FIG. 9
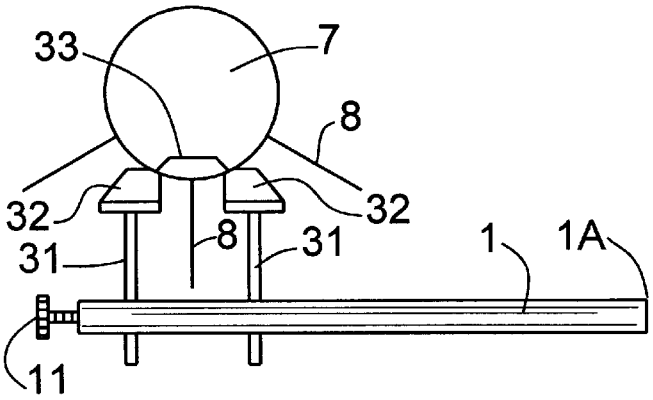
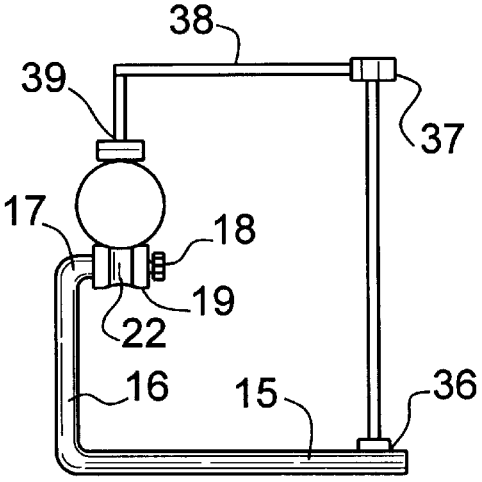
FIG. 7
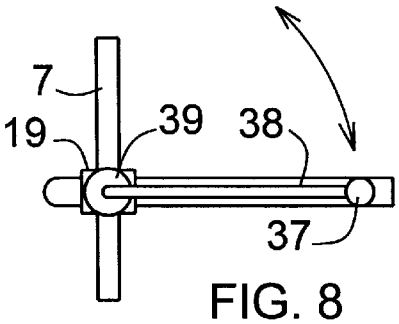
FIG. 8

ARROW REST

CROSS-REFERENCE TO RELATED APPLICATIONS

There are no related applications

STATEMENT AS TO RIGHTS TO INVENTIONS MADE UNDER FEDERALLY SPONSORED RESEARCH AND DEVELOPMENT

The invention disclosed and claimed herein was not made under any Federally sponsored research and development program.

BACKGROUND OF THE INVENTION

The present invention relates in general to archery and more particularly to devices useful as an arrow rest with a bow to launch arrows from the bow.

Arrow rests are typically used in both sport and hunting activities utilizing bows to stabilize the arrow before it is launched from the bow. In general arrow rests are located on a lateral extension of the mid portion of the bow and permit accurate aim.

Typical prior art rests are taught by U. S. Pat. No. 5,137,006 which provides a pair of spaced elongate supports to support the arrow therebetween. The supports are flexible to allow selected depression of the arrow on the rest by adjustment of the angle of attack of the supports.

Another rest configuration is disclosed in U.S. Pat. No. 3,935,854 teaches a rest with vertical depression which is asserted to improve accuracy by dampening vertical oscillation of the arrow off the rest.

U. S. Pat. No. 5,107,818 teaches an arrangement which is easily laterally adjusted and includes a support member which pivots in response to the arrow vanes passing over it to maintain stability.

U.S. Pat. No. 5,322,048 teaches an arrow rest using a grooved block where the arrow rests in the vertical groove.

No prior art arrangement is known which provides the advantages of devices within the scope of the present invention.

SUMMARY OF THE INVENTION

The present invention relates to arrow rests for bows and more particularly to an effective and efficient arrangement for resting an arrow prior to launch.

Devices within the scope of the present invention eliminate the mechanical apparatus required of prior apparatus and provide more reliable operation than available previous apparatus.

More particularly, devices within the scope of the present invention utilize block(s) of low friction material with groove means to position the arrow where the block guides the arrow during launch can be shaped to prevent contact with the vanes of the arrow as it is launched. Accordingly, devices within the scope of the present invention advantageously allow launch of the arrow with minimal interference and deflection of the arrow during launch.

More particularly, the present invention provides an arrow rest arrangement for an archery bow including a rod rotatably received in base member attached to the bow where a pin extends outwardly from the rod and holds an arrow rest which is formed from low friction polymer and adapted to support an arrow prior to launching and provide initial guidance to the arrow at launch.

Arrangements within the scope of the present invention provide many advantages over prior art arrangements including the fact that the devices are reversible on the bow, are very quiet, can be used equally well by both left and right hand shooters and allow launching the arrow without significant interference.

Examples within the scope of the present invention are illustrated in the accompanying drawings and described hereinafter but it will be understood that other arrangements also within the scope of the present invention will occur to those skilled in the art upon reading the disclosure set forth hereinafter.

BRIEF DESCRIPTION OF THE PREFERRED EMBODIMENTS

Examples of devices within the scope of the present invention are shown in the accompanying illustrations where:

FIGS. 7 and 8 illustrate an example of an arrangement within the scope of the present invention for use where the arrow can be retained in the holder until launched;

FIG. 9 illustrates another example of an arrangement within the scope of the present invention utilizing a post type rest; and FIGS. 10 and 11 illustrate an example of an arrangement within the scope of the present invention where the rest block is held on a single post.

DETAILED DESCRIPTION OF THE DRAWINGS

Figure 1:
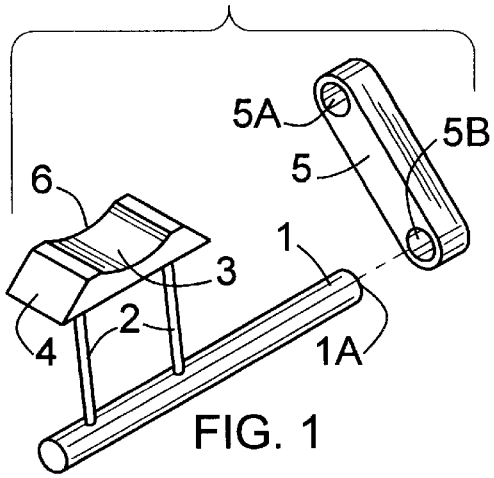
FIGS. 1 and 2 illustrate an example of one arrangement within the scope of the present invention.

FIG. 1 illustrates one example of an arrow rest within the scope of the present invention where a rod 1 is provided having an end 1A adapted to be received in an aperture 5A of a holder 5 which is attached to a bow (not shown) by means of an aperture 5B as is known in the art. As shown in FIG. 1 a rest block 3 is attached to rod 1 to be located in spaced relation from the rod. In the example shown FIG. 1 block 3 is connected to rod 1 by pins two 2 which are seated in rod 1 at one end and in the block 3 at the other end. In this manner block 3 is spaced above the rod and provides room for travel of the arrow 7 as described hereinafter.

Figure 2:
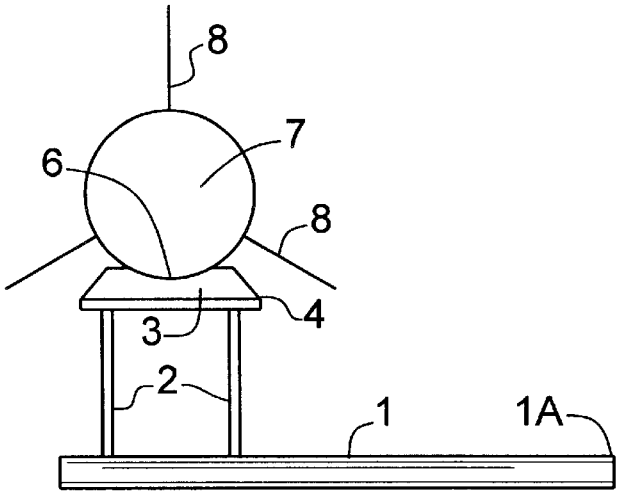

In accordance with one feature of the example of the present invention shown in FIGS. 1 and 2 block 3 and the other blocks shown in the other Figures is fabricated of a material which has low frictional coefficients in order to reduce the drag suffered by the arrow during launch and to improve the accuracy of the release of the arrow from the bow. TEFLON®, tetrafluoroethylene and TEFLON® composites such as teflon-graphite composites have been found to be satisfactory.

In accordance with another feature of the example of the present invention shown in FIGS. 1 and 2, a groove 6 is provided in the rest block 3 to receive the shaft of an arrow 7 (FIG. 2) to guide the arrow out of the block. Additionally, in accordance with another feature of the example of the present invention shown in FIGS. 1 and 2, the sides 4 of the block 3 are tapered so the vanes 8 of arrow 7 can be aligned when the arrow is poised for launch so the vanes do not contact the block to divert the path of the arrow.

Figure 3:
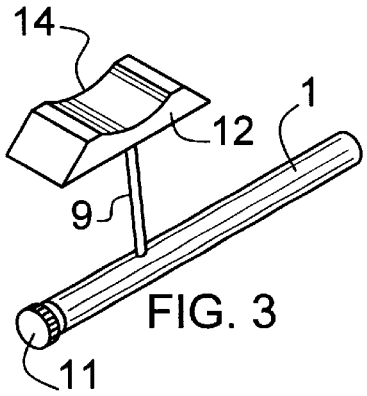
FIGS. 3 and 4 illustrate an example of an arrangement within the scope of the present invention where the rest block is held on a single post.
Figure 4:
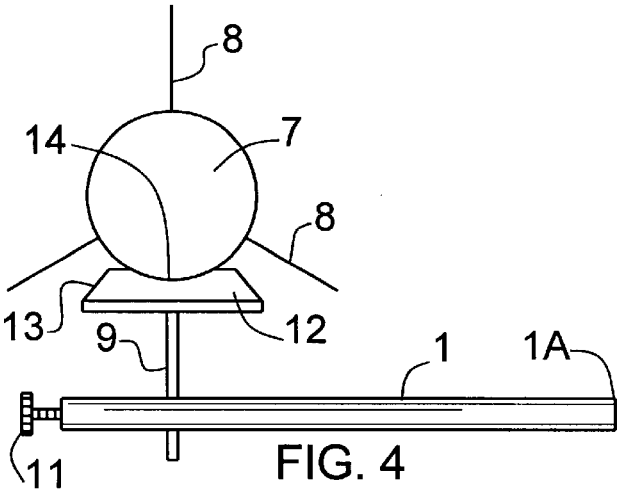

In FIGS. 3 and 4, a rest block 12 is attached to rod 1 to again be located in spaced relation from the rod. In the example shown in FIGS. 3 and 4, block 12 is connected to rod 1 by a single pin 9 which can be seated in rod 1 at one end or can be received in an aperture in rod 1 and secured by a bolt 11 so that the distance of the block from the rod can be adjusted. As described with reference to FIGS. 1 and 2 the opposite end of the rod 1 is received in a mounting device such as holder 5 of FIG. 1. In this manner block 3 is adjustably spaced above the rod and the distance of the block from the holder 5 can be adjusted to provide room for travel of the arrow 7 as described hereinafter.

Again in accordance with another feature of the example of the present invention as described in FIGS. 1, and 2 a groove 14 is provided in the rest block 12 to receive the shaft of an arrow 7 (FIG. 2) to guide the arrow out of the block. As also described previously in accordance with another feature of the example of the present invention shown in FIGS. 3 and 4, the sides 13 of the block 12 are tapered so the vanes 8 of arrow 7 can be aligned when the arrow is poised for launch so the vanes do not contact the block to divert the path of the arrow.

Figure 5:
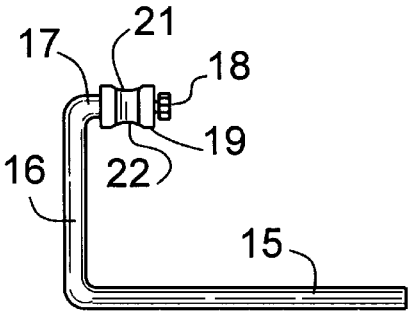
FIGS. 5 and 6 illustrate an example of an arrangement within the scope of the present invention for use where arrows of different size can be accommodated.
Figure 6:
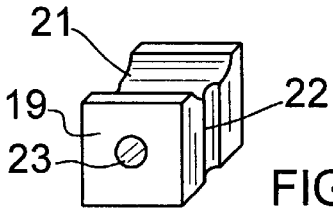

FIGS. 5 and 6 present another arrangement within the scope of the present invention including a rest block 19 is attached to an axis 17 and retained by a nut 18 to again be located in spaced relation from the rod. In the example shown in FIGS. 5, and 6 axis 17 is carried by an arm 16 which is in turn carried by a rod 15 equivalent to rod 1 of the previous Figures to be received in an aperture of a holder as previously described and secured to the bow (not shown) so that the distance of the block from the bow can be adjusted. In this manner the distance of the block from the holder 5 can be adjusted to provide room for travel of the arrow 7 as described hereinafter.

Again in accordance with another feature of the example of the present invention as described in FIGS. 1, and 2 block 19 is provided with at least two grooves 21, 22 allow the block to be rotated to different positions to receive the arrow shafts of different diameter. In practice, different diameter arrows are used for different purposes and devices of the type shown in FIGS. 5 and 6 allow the arrow size to be changed without changing the arrow rest as required by some prior art devices. Also, multiple sided blocks can be provided. As also discussed previously in accordance with another feature of the example of the present invention shown in FIGS. 5 and 6 the width of the block 19 secured to axis 17 with a nut 18 can be selected so the vanes 8 of arrow 7 can be aligned when the arrow is poised for launch so the vanes do not contact the block to divert the path of the arrow.

FIG. 6A illustrates yet another arrangement within the scope of the present invention where an elongate rest block is provided having a body 26 of a material of low frictional coefficient yet sufficient rigidity to reliably support an arrow. Such materials include TEFLON® composites. A pin 28 extends out of the bottom of the body for attachment to a rod such as rod 1 of the examples of FIGS. 1–4.

In FIG. 9 a pair of rest blocks 32 are attached to rod 1 in spaced relation by pins 31. In the example shown in FIGS. 5, 6B blocks 32 have tapered inner surfaces 33 to define an opening therebetween to receive the arrow shaft. As described with reference to FIGS. 1, and 2 the opposite end of the rod 1 is received in a mounting device such as holder 5 of FIG. 1A. In this manner blocks 32 can be adjustably spaced above the rod and the distance of the block from the holder 5 can be adjusted to provide room for travel of the arrow 7 as described previously.

Also, the width between the outer edges of blocks 32 can be such that the vanes of the arrow pass through without contact.

FIGS. 7 and 8 illustrate another arrangement within the scope of the present invention illustrated with reference to the arrangement shown in FIG. 9 but it will be understood that the features could be used with the examples of any of the figures.

The arrangement shown in FIGS. 4A–4B provides means for steadying the arrow prior to launch. In the arrangement shown, a post 36 is provided to extend upwardly from rod 1 and carries a swivel 37 which can be one way to allow an arm 38 to swing out of the way as the arrow leaves the rest. The arm can then be manually relocated when a new arrow is placed in the holders 32. Additionally a foot 39 can be provided to rest lightly on the arrow as shown.

It will be understood that the foregoing are but a few examples of arrangements within the scope of the present invention and that other arrangements also within the scope of the present invention will occur to those skilled in the art upon reading the disclosure.

The invention claimed is:

1. An arrow rest arrangement for an archery bow for use with an arrow having a shaft, comprising:

a rod;

a base member attached to said bow and adapted to receive said rod;

a pin received by said rod to extend outwardly from said rod;

an arrow rest block carried by said pin having at least one indentation to support said arrow shaft prior to launching;

an arrow shaft retainer including post extending outwardly from said rod;

means for swiveling at the distal end of said post;

an arm received by said means for swiveling adapted to be moved from first position to contact said arrow shaft in said arrow rest to a second position away from said arrow shaft.

2. The invention of claim 1, wherein said arrow rest block comprises material with low frictional coefficient relative to said arrow shaft.

3. The invention of claim 1, wherein said rod includes means for selectively adjusting the height of said arrow rest block above said rod.

4. The arrow rest of claim 1, wherein said arrow rest block is multi-sided and includes at least one indentation in at least two of said sides.

5. An arrow rest arrangement for an archery bow including;

a rod;

a base member attached to said bow and adapted to receive said rod;

a bracket extending outwardly from said rod;

an axis extending parallel to said rod from the end of said bracket;

an arrow rest block having an aperture for receiving said axis, said arrow rest block having a indentation for supporting an arrow shaft prior to launching.

6. The invention of claim 5, wherein said block is multi-sided and includes an indentation in at least two sides to receive said arrow shaft, said indentation being of a different size in each said side.

7. An arrow rest arrangement for an archery bow for use with an arrow having a shaft, comprising:

a rod;

a base member attached to said bow and adapted to receive said rod;

at least one pin received by said rod to extend outwardly from said rod;

at least one arrow rest block carried by said at least one pin having means for guiding and supporting said arrow shaft prior to launching;

an arrow shaft retainer including a post extending outwardly from said rod;

means for swiveling at the distal end of said post; and an arm received by said means for swiveling adapted to be moved from a first position to contact said arrow shaft in said arrow rest to a second position away from said arrow shaft.

8. The arrow rest of claim 7, wherein said means for guiding and supporting said arrow shaft is at least one indentation formed in said arrow rest block.

9. The arrow rest of claim 8, wherein said arrow rest block includes at least two indentations of different sizes.

10. The arrow rest of claim 7, a wherein said arrow rest block comprises material with low frictional coefficient relative to said arrow shaft.

11. The arrow rest of claim 7, wherein said rod includes means for adjusting the height of said arrow rest block above said rod.

12. The arrow rest of claim 7, said means for guiding and supporting said arrow shaft comprising an arrow rest block having at least one tapered surface thereon.

13. An arrow rest arrangement for an archery bow for use with an arrow having a shaft, comprising:

a rod;

a base member attached to said bow and adapted to receive said rod;

a pin received by said rod to extend outwardly from said rod;

an arrow rest block carried by said at least one pin for supporting said arrow shaft prior to launching;

means for selectively retaining and releasing said arrow shaft in said arrow rest block; and said arrow rest block including at least two indentations.

14. The arrow rest of claim 13, wherein said arrow rest block includes at least one tapered surface.

15. The arrow rest of claim 13, wherein said rod includes means for adjusting the height of said arrow rest block above said rod.

16. The arrow rest of claim 13 wherein said arrow rest block comprises material with low frictional coefficient relative to said arrow shaft.

17. The invention of claim 16, wherein at least a portion of said material having a low frictional coefficient comprises the polymer tetrafluoroethylene.

18. The arrow rest of claim 13 wherein said at least two indentations are of different sizes.

* * * * *